US006145808A

United States Patent [19]

Hickman

[11] Patent Number: 6,145,808

[45] Date of Patent: Nov. 14, 2000

[54] DRAIN VALVE FOR A WATER HEATER

[76] Inventor: Gary Hickman, P.O. Box 868, Overton, Nev. 89040

[21] Appl. No.: 09/137,742

[22] Filed: Aug. 21, 1998

[51] Int. Cl.[7] ..... F16K 49/00

[52] U.S. Cl. ..... 251/144; 137/269; 137/337; 137/341; 137/563

[58] Field of Search ..... 251/144; 137/563, 137/334, 337, 315, 269, 341

[56] References Cited

U.S. PATENT DOCUMENTS

| | | | |
|---|---|---|---|
| 620,947 | 3/1899 | Moorre | 137/337 |
| 993,509 | 5/1911 | Cowles | 137/337 |
| 1,765,433 | 6/1930 | Lavett | 137/563 |
| 2,758,610 | 8/1956 | Hively | 137/605 |
| 2,892,465 | 6/1959 | Lyle | 137/337 |
| 3,107,082 | 10/1963 | Reynolds | 137/269 |
| 3,190,284 | 6/1965 | Koepf | 126/362 |
| 3,412,757 | 11/1968 | Watts | 137/606 |
| 3,556,124 | 1/1971 | Walton | 137/337 |
| 4,790,289 | 12/1988 | Barrett | 137/563 |
| 5,033,499 | 7/1991 | Patel et al. | 137/269 |
| 5,518,022 | 5/1996 | Ziehm | 137/337 |
| 5,671,771 | 9/1997 | Brandel | 137/337 |

*Primary Examiner*—A. Michael Chambers
*Attorney, Agent, or Firm*—Kenneth L Tolar

[57] ABSTRACT

A drain valve for a hot water heater includes a hollow tubular portion having a tapered first end with an externally threaded neck extending therefrom. The tubular portion includes a pair of diametrically opposed internally threaded ports each having a plug received therein. Either plug may be removed allowing a hot water recirculation line to be conveniently attached to the valve. The opposing end of the tubular portion includes a downwardly depending nozzle having a valve means therein operable with an externally mounted handle. The nozzle includes an externally threaded circumferential rim to which a drain conduit may be coupled for conveniently draining the water heater. Accordingly, the threaded neck may be coupled with a tap on a conventional hot water heater allowing a recirculation line to be conveniently added at a later date with minimal reconstruction of the existing piping.

4 Claims, 1 Drawing Sheet

DRAIN VALVE FOR A WATER HEATER

BACKGROUND OF THE INVENTION

The present invention relates to drain valve for a water heater that allows a hot water recirculation system to be subsequently installed with minimal reconstruction of the existing piping.

DESCRIPTION OF THE PRIOR ART

In certain geographical areas, such as the Southwestern United States, water is scarce requiring various conservation measures. Because water in a hot water supply line remains stagnant for prolonged durations, the line must be drained for a predetermined period until hot water actually flows through a faucet resulting in significant waste. Accordingly, certain municipalities require that new homes be constructed with a hot water recirculation system in which hot water is continuously pumped from the tank through the hot water supply piping assuring that hot water is readily available. However, attaching the recirculation piping to an existing hot water heater is cumbersome and laborious. The existing water heater drain valve must be removed and replaced with a T-connector to which the drain valve and a recirculation line are attached.

The present invention provides a uniquely configured drain valve which allows a recirculation system or similar auxiliary piping to be quickly and conveniently installed without installing a T-connector or other fittings. Although various valves and hot water recirculation systems exist in the prior art, none have the unique features and advantages of the present invention. For example, U.S. Pat. No. 5,671,771 issued to Brandel relates to a hot water plumbing system comprising a hot water heater delivery location, a delivery line, a riser located adjacent the delivery location and a return line.

U.S. Pat. No. 5,518,022 issued to Ziehm relates to an aspirator water circulation apparatus for providing instant hot water to faucets remote from a water heater.

U.S. Pat. No. 3,190,284 issued to Koepf relates to a container with a mixing device.

U.S. Pat. No. 2,758,610 issued to Hively relates to a valve for tempering water.

U.S. Pat. No. 3,556,124 issued to Walton relates to an instant hot water system having a return line from the far end of the hot water supply line to the cold water inlet of the water heater. At the intersection of the return line and cold water supply line is a piston valve which closes the return line when cold water flows into the heater.

U.S. Pat. No. 3,412,757 issued to Watts relates to a mixing valve.

Although various devices related to water heaters exist in the prior art, none have the unique features and advantages according to the present invention. The present invention provides a uniquely configured drain valve having a pair of opposing, threaded ports thereon allowing water recirculation piping to be quickly and easily coupled with the hot water heater without removing the drain valve.

SUMMARY OF THE INVENTION

The present invention relates to a uniquely configured drain valve for a water heater. The device includes an elongated hollow tubular portion having an externally threaded neck at a first end for threadedly coupling the device with a water heater drain tap. The opposing end includes an angularly depending nozzle having a valve therein that is operable with a handle. The nozzle includes an externally threaded, circumferential rim for threadedly coupling the nozzle with a hose when draining the water heater. The tubular portion includes a pair of diametrically opposed threaded ports each normally receiving a threaded plug member. Either plug member may be removed for threadedly coupling a pipe thereto such as a return line for a hot water recirculation system. It is therefore an object of the present invention to provide a drain valve for a water heater that is easy to install and inexpensive to manufacture.

It is yet another object of the present invention to provide a drain valve for a water heater that allows a hot water recirculation system to be conveniently installed.

It is yet another object of the present invention to provide a drain valve for a water heater that provides a convenient means for conserving water. Other objects, features and advantages of the present invention will become readily apparent from the following detailed description of the preferred embodiment when considered with the attached drawings and the appended claims.

DESCRIPTION OF THE PREFERRED EMBODIMENT

Figure 3:
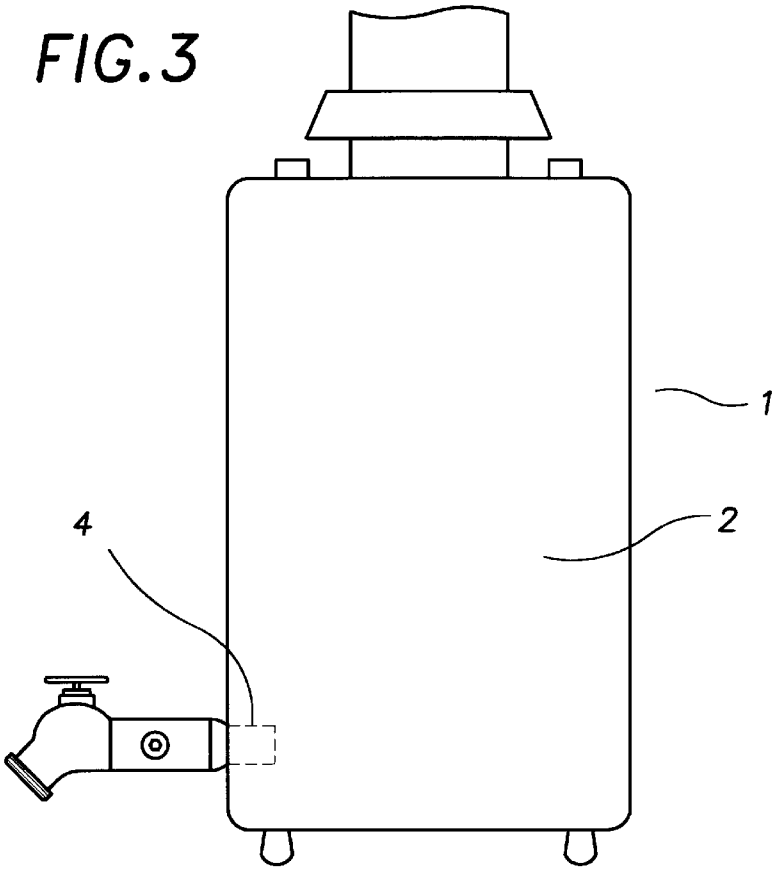
FIG. 3 depicts the inventive device installed on a water heater.
Figure 1:
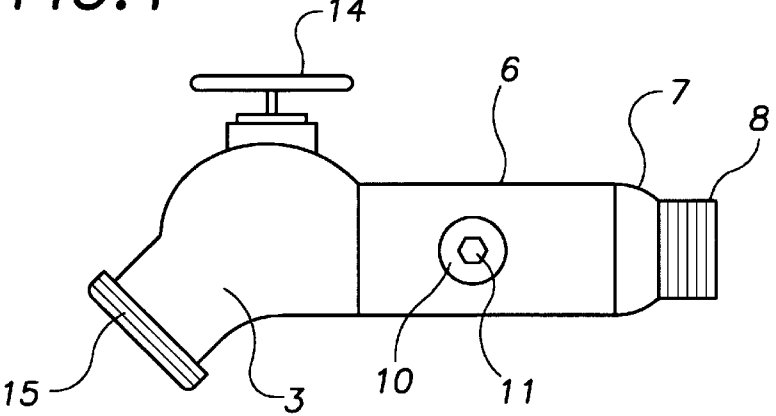
FIG. 1 is a side view of the inventive device.
Figure 2:
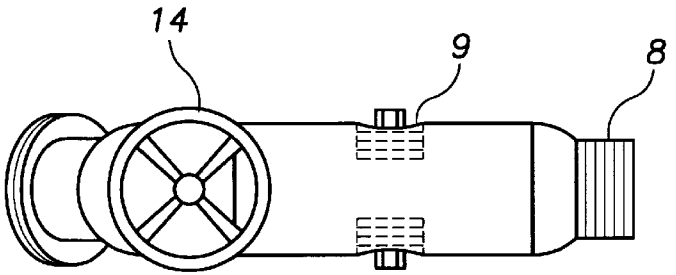
FIG. 2 is a top view of the inventive device.

Referring now to FIGS. 1 through 3, the present invention relates to a drain valve for a water heater. A conventional water heater 1 typically includes a cylindrical water storage tank 2 having a supply line in communication therewith which supplies hot water to various locations within a building. The cylindrical tank typically includes a threaded tap 4 adjacent the bottom end thereof in communication with the tank interior. A conventional drain valve (not pictured) is typically threadedly coupled to the tap for draining the hot water heater.

The present invention relates to a drain valve for coupling with a hot water heater as described above. The device comprises an elongated tubular portion 6 having a tapered first end 7 and an externally threaded neck 8 extending therefrom. The externally threaded neck portion is configured and dimensioned to threadedly engage the threaded tap on the hot water heater tank.

The tubular portion includes two internally threaded, diametrically opposed ports 9. Each port may be sealed with a threaded plug member 10 having an engagement member 11 on a side thereof allowing the plug to be easily removed with a tool such as a wrench. The internally threaded ports are dimensioned to threadedly engage the externally threaded portion of a water pipe. Accordingly, a recirculation pipe may be attached to either side of the tubular portion, whichever is more convenient or accessible.

On an end of the tubular portion opposite the tapered end is an angularly depending nozzle 3 having a valve means received therein. The valve means is operable with an external handle 14. A distal end of the nozzle includes an externally threaded circumferential rim 15 for receiving a threaded coupling member on a hose or similar drain conduit.

Accordingly, the above described device may be secured to a hot water heater in place of the conventional drain valve.

If a user later desires to install a hot water recirculation system, a drain hose is attached to the downwardly depending nozzle and the water heater is drained. The recirculation line is installed as usual and is coupled to one of the ports on a side of the drain valve, whichever is more accessible. The invention as described above eliminates the burdensome practice of removing the valve, installing a T-connector on the threaded tap and attaching the conventional drain valve and recirculation line thereto.

The above described device is preferably made from steel, stainless steel, plastic or brass. However, as will be readily apparent to those skilled in the art, the size, shape and materials of construction may be varied without departing from the spirit of the present invention.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. In combination with a water heater including a cylindrical water holding tank having a bottom end with a threaded tap adjacent thereto in communication with the tank, a drain valve comprising:

a hollow tubular portion having two opposing ends with a threaded neck at a first end thereof, said neck dimensioned and configured to threadedly engage said tap, said tubular portion further including a pair of opposing, threaded ports each having a removable plug member received therein, each of said ports dimensioned and configured to threadedly engage a pipe.

2. The drain valve according to claim 1 wherein said tubular portion further includes a nozzle depending from a second end, said nozzle adapted to be coupled with a drain conduit for draining said tank.

3. The drain valve according to claim 2 further comprising:

a valve received within said nozzle;

a handle extending from said tubular portion for manipulating said valve to control water flow through said nozzle.

4. In combination with a water heater including a cylindrical water holding tank having a bottom end with a threaded tap adjacent thereto in communication with the tank, a drain valve comprising:

a hollow tubular portion having two opposing ends with an externally threaded neck at a first end thereof, said neck dimensioned and configured to threadedly engage said tap, said tubular portion further including a pair of opposing, internally threaded ports each having a removable plug member received therein, each of said ports dimensioned and configured to threadedly receive the externally threaded portion of a pipe, said tubular portion further including a nozzle angularly depending from its second end, said nozzle having a circumferential, externally threaded rim for coupling said nozzle to a drain conduit for draining said tank;

a valve means received within said nozzle, said valve means controllable with a handle extending from said tubular portion for controlling water flow through said nozzle.

* * * * *